United States Patent [19]

Verhulst

[11] Patent Number: 4,877,063

[45] Date of Patent: Oct. 31, 1989

[54] MAIN INJECTOR WITH INCREASED TENSIONING FORCE, FOR AIRJET WEAVING MACHINES

[75] Inventor: Jozef Verhulst, Zillebeke, Belgium

[73] Assignee: Picanol N.V., Ypres, Belgium

[21] Appl. No.: 331,084

[22] Filed: Mar. 28, 1989

Related U.S. Application Data

[63] Continuation of Ser. No. 127,060, Dec. 1, 1987, abandoned.

[30] Foreign Application Priority Data

Dec. 2, 1986 [NL] Netherlands ..... 8603069

[51] Int. Cl.[4] ..... D03D 47/30

[52] U.S. Cl. ..... 139/435

[58] Field of Search ..... 139/435; 226/97

[56] References Cited

U.S. PATENT DOCUMENTS

| | | | |
|---|---|---|---|
| 4,125,133 | 11/1978 | Kobayashi et al. | 139/435 |
| 4,353,397 | 10/1982 | Tera et al. | 139/435 |
| 4,367,772 | 1/1983 | Wall | 139/435 |
| 4,433,706 | 2/1984 | Takahashi et al. | 139/435 |
| 4,494,888 | 1/1985 | Honda et al. | 139/435 |

*Primary Examiner*—Henry S. Jaudon

*Attorney, Agent, or Firm*—Bacon & Thomas

[57] ABSTRACT

An apparatus for fluidly injecting a weft thread into the shed of a weaving loom with increased force exerted on the weft thread consists of a main injection nozzle and a fluid jet injection tube of predetermined length and constant cross section diameter fixed coaxially to the exit passage of the nozzle, with the tube having a plurality of fluid outlet openings positioned in groups, with the openings located symmetrically to the axis of the tube and with the openings of each group intersecting a single plane to permit and symmetrical of the equal egress fluid from the tube through each of the openings.

18 Claims, 3 Drawing Sheets

Fig. 9
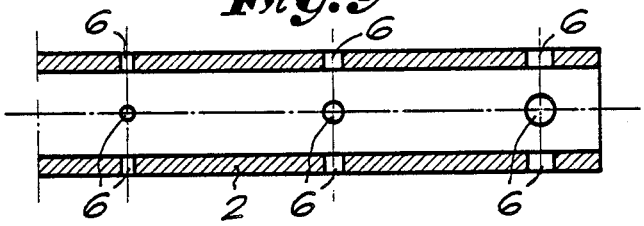
Fig. 10
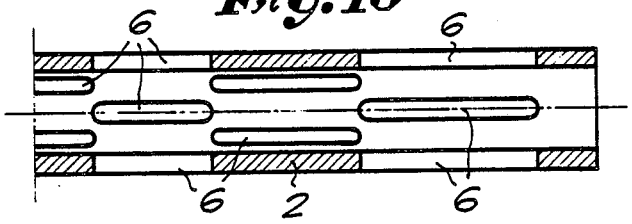
Fig. 11
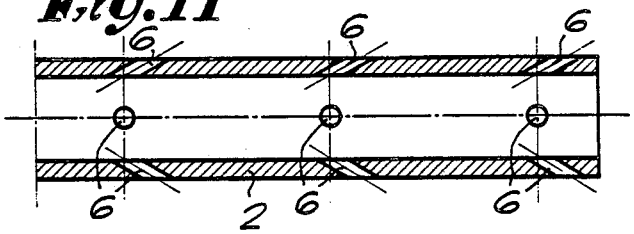
Fig. 12
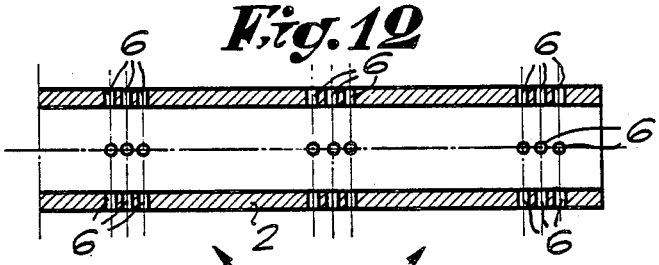
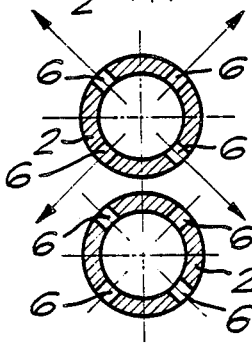
Fig. 13

MAIN INJECTOR WITH INCREASED TENSIONING FORCE, FOR AIRJET WEAVING MACHINES

This application is a continuation of application Ser. No. 127,060, filed Dec. 1, 1987 now abandoned.

BACKGROUND OF THE INVENTION

This invention concerns a main injector which increases the weft thread tensioning force, for use in airjet weaving machines.

Such a main injector is mounted in front of the shed, with the purpose of injecting the pick into the shed with as high a velocity as possible.

More particularly, the present invention concerns a main injector comprising a main injector tube extending from the main injector, a hollow threading needle and a mixing zone inside the main injector, and a compressed air supply.

The aim of this invention is to achieve as great a weft thread force as possible. In the prior art this is normally done by increasing the air injection pressure and/or increasing the length of the tube and/or decreasing the tube diameter.

However, all of these methods have disadvantages caused by phenomena associated with the flow of air in the tube.

Regions of fluid turbulence are produced in the tube due to the friction between the fluid medium and the tube wall and/or the internal friction within the medium itself and/or the friction between the medium and the thread being injected. This turbulence, which mainly occurs in the region adjacent the tube wall, has the effect of reducing the effective tube diameter, i.e., the diameter of the region at the center of the tube in which there is a well-defined undisturbed airflow.

Another phenomenon associated with main injectors of the prior art is that the airflow is forced to follow the same path as that of the thread, so that the tensioning force exerted on the thread is greater than would be the case if no tube was used. This favorable phenomenon can be accentuated by increasing the length of the injector tube.

However, because the amount of friction between the fluid medium and the tube wall increases with the length of the tube, so also does the amount of fluid turbulence increase, thus unfavorably affecting the tensioning force on the thread and cancelling out any advantage which might be obtained by having a longer tube.

Another known phenomenon associated with main injectors of the prior art is that the transmission of force to the thread is greater with a smaller tube diameter than with a larger diameter. Because this favorable effect also disappears when the tube diameter becomes so small that the fluid turbulence produced in the region adjacent the tube wall reduces the effective tube diameter to the extent that there is no longer a well-defined, undisturbed airflow, the minimum permissible tube diameter is determined by the size of the turbulent regions and the thickness of the thickest weft thread to be inserted.

It is therefore very important for the thread to be positioned as centrally as possible within the well-defined airflow at the center of the tube and for there to be as little turbulence as possible in the region adjacent the tube wall and to be able to increase the length of the tube and decrease the diameter without the negative effects on pick injection, and to obtain greater tensioning force with the main injector.

Finally, the length of the main injector tube on airjet machines is normally determined by the amount of space available within the construction.

SUMMARY OF THE INVENTION

In the present invention, use is made of the above-mentioned advantageous phenomena by providing a main injector tube which, within the space available, has a mainly constant diameter, is as long as possible; has as small an internal diameter as possible in relation to the thread thickness used; and which has groups of openings to let turbulent fluid flow adjacent the tube wall escape while at the same time keeping the weft thread as centrally positioned as possible in the well-defined airflow in order to limit friction between the thread and the tube.

These groups of openings are positioned so that the escaping air flows away from the center of the tube equally and symmetrically, with the same amount of air escaping from each opening, so that the escape of air does not affect the well-defined air flow at the center of the tube and the central position of the thread with the injector tube. The various aspects of the openings and their positions relative to the tube should preferably be designed so as to favorably affect the escape of air directly intto ambient atmosphere.

BRIEF DESCRIPTION OF THE DRAWINGS

In order to explain the characteristics of the invention, by way of example only and without being limitative in any way, the following preferred embodiments of a main injector according to the present invention are described with reference to the accompanying drawings, where:

FIGS. 7 to 12 are equivalent to FIG. 3 and show further embodiments of the invention.

FIG. 13 shows a configuration with two main injector tubes mounted one above the other ("over-and-under" configuration).

DESCRIPTION OF THE PREFERRED EMBODIMENTS

Figure 1:
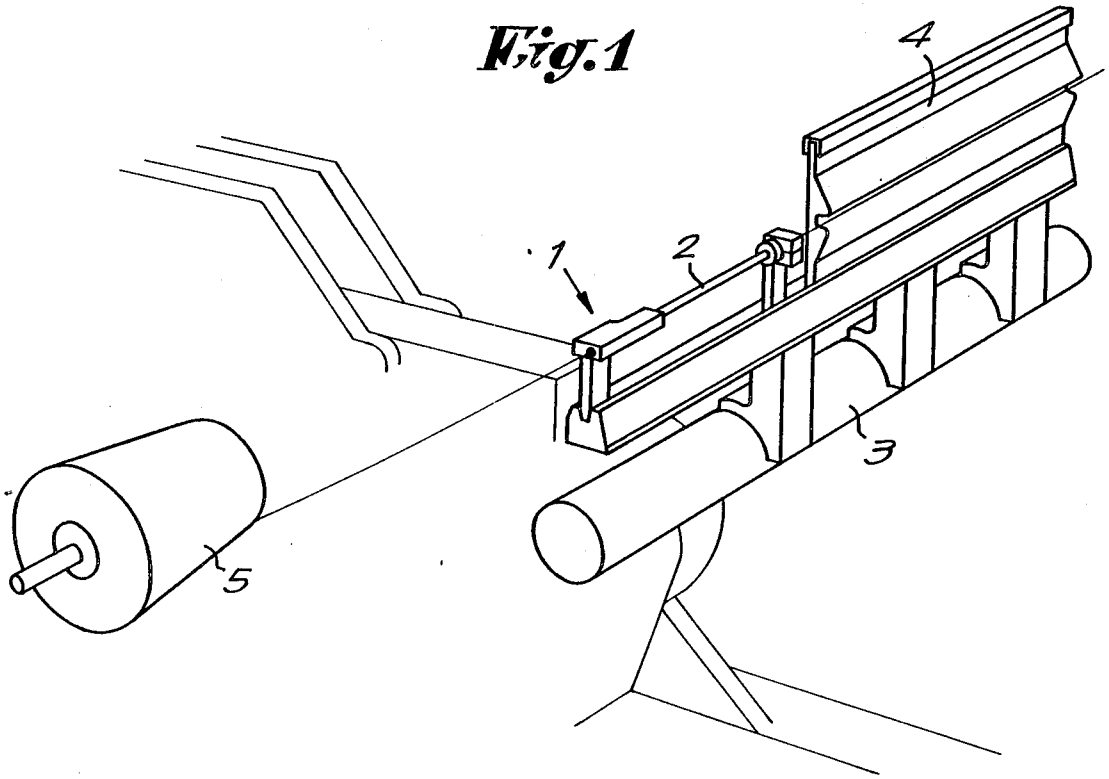
FIG. 1 is a perspective drawing showing the positioning of the various components of the invention relative to components of a conventional loom structure.

FIG. 1 shows, in a very schematic way, a main injector 1 with a main injector tube 2 according to the invention, fixedly disposed at the exit end of main injector 1 and coaxially therewith. The injector 1 and tube 2 are both mounted on the sley 3, on which the reed 4 is also mounted. The injector 1 is supplied with weft thread from a bobbin 5.

Figure 2:
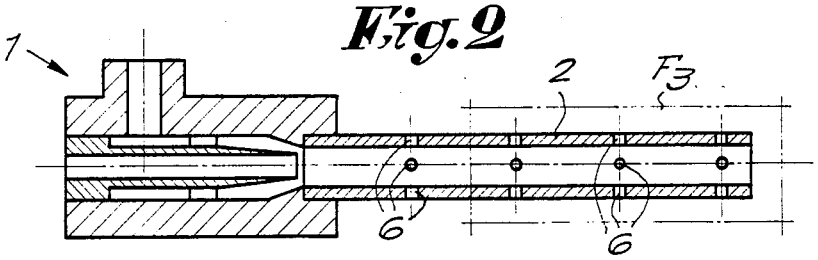
FIG. 2 is a schematic cross-section showing the relative positions of a main injector and a main injector tube according to the present invention.
Figure 3:
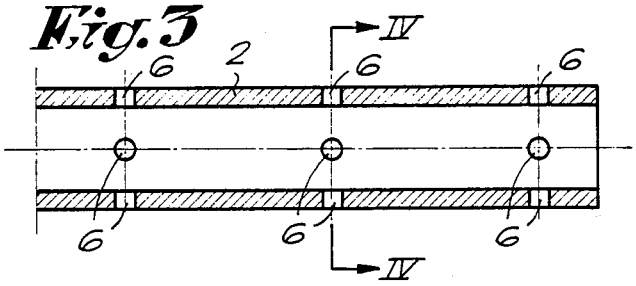
FIG. 3 shows the portion of FIG. 2 indicated by F3, drawn to a greater scale.
Figure 4:
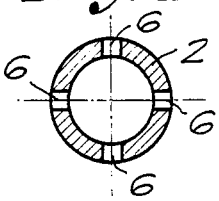
FIG. 4 is a cross-section along the line IV—IV in FIG. 3.

FIG. 2 is a schematic drawing of a main injector 1 with an injector tube 2 which has groups of symmetrically-positioned air outlet holes 6 located at regular consistently spaced distances from each other, through which unwanted turbulent air can escape while the main injector is operating. In this embodiment, as shown in FIGS. 3 and 4, equally spaced along the length of the tube 3 there are four groups of symmetrically-positioned round openings per tube cross section with the outlet openings of each group intersecting an imaginary plane extending transversely perpendicular to the axis of the tube, so that fluid will egress equally from the openings of each group intersecting the single plane.

Figure 5:
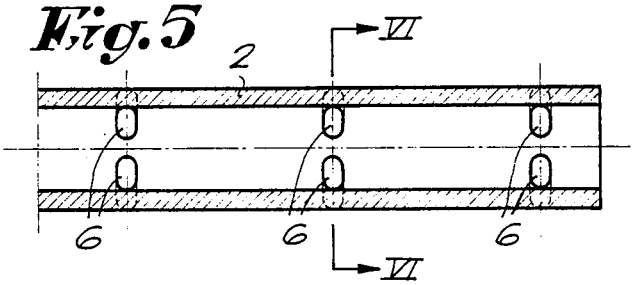
FIG. 5 shows an additional embodiment of the injector tube of FIG. 3.
Figure 6:
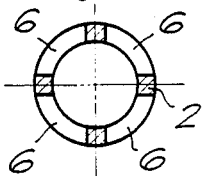
FIG. 6 is a cross-section along the line VI—VI in FIG. 5.

FIGS. 5 and 6 show another embodiment of the invention in which the openings 6 of each group are oblong, having a greater length than width, with their length perpendicular to the longitudinal axis of the tube 2.

Figure 7:
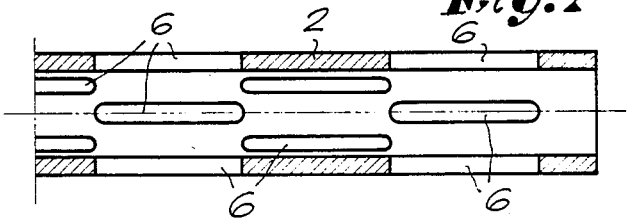

FIG. 7 shows a embodiment in which the openings 6 of each group are long and narrow, they extend along the length of the tube 2, and they are placed in an oblique formation.

Figure 8:
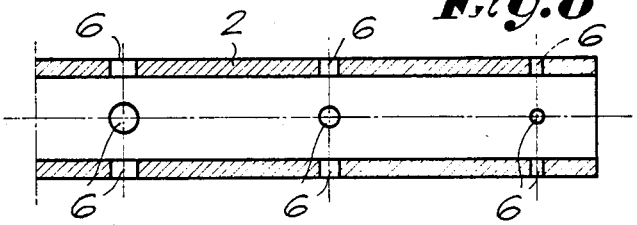

FIG. 8 shows an embodiment in which the diameter of the openings 6 of each group becomes smaller along the length of the tube with each successive cross section of the tube, while FIG. 9 shows an embodiment in which the diameter of the openings becomes larger with each successive tube section.

FIG. 10 shows a similar arrangement to FIG. 9 with the area of the openings becoming larger along the tube length, but with slit-shaped openings 6 that are obliquely spaced as in FIG. 7.

FIG. 11 shows an embodiment in which the openings 6 are positioned at an angle of less than 90 degrees with respect to the tube axis in order to facilitate the escape of turbulent air, while FIG. 12 shows an embodiment in which the groups of openings 6 includes smaller sub-groups of openings, with each sub-group equally spaced along the tube.

Although the groups of openings 6 as shown in the accompanying drawings are all placed at regular intervals from one another along the length of the tube, the intervals can of course be progressively larger or smaller, starting from the main injector 1. However, in all cases, the outlet openings of each group or sub-group are disposed symmetrically around the tube axis and intersect a common transverse perpendicular plane to insure equal and symmetrical egress of air from each outlet opening during weft insertion.

Finally, FIG. 13 represents a configuration with two main injectors places one above the other (over-and-under configuration). Here it is clearly shown that the tubes are arranged with respect to each other in such a way that the air escaping through the openings 6 is not obstructed in any way by their environment; in other words the tubes must not impede each other and the air escaping from one tube does not impede the air escaping from the other tube.

In general, the most suitable position, number and shape of the openings 6 will be determined experimentally to suite the yarn to be inserted into the shed.

Clearly, the present invention is in no way restricted to the embodiments described by way of example shown in the accompanying drawings; on the contrary, such a main injector tube and the openings 6 in it can be made in all sorts of forms and dimensions while still remaining within the scope of the invention.

I claim:

1. An apparatus for fluidly injecting a weft thread into a shed of a weaving loom with increased tensile force exerted on the weft thread comprising:

a main injection nozzle having a weft admission passage, a fluid pressure admission passage, and an exit passage; and a fluid jet injection tube of predetermined length and constant cross section diameter fixedly disposed coaxially to the exit passage of the main nozzle and adjacent the exit outlet of the main nozzle, and having at least one group of fluid outlet openings in direct communication with ambient atmosphere extending through the wall of the tube and positioned symmetrically to the axis of the tube, the outlet openings of said at least one group intersecting a single plane extending transversely perpendicular to the axis of the tube, whereby pressurized fluid passing through the tube will egress equally from each of the openings of the group symmetrically to the axis of the tube.

2. An apparatus as claimed in claim 1, wherein a plurality of groups of outlet openings are positioned along the tube length with the openings of each group intersecting a respective single plane extending transversely perpendicular to the axis of the tube.

3. An apparatus as claimed in claim 1 or 2, wherein the outlet openings of each group extend to the wall of the tube at an angle of less than 90° to the axis of the tube.

4. An apparatus as claimed in claim 1 or 2, wherein the outlet openings are oblong in shape and the walls of the openings extend through the tube at an angle of less than 90° to the axis of the tube.

5. An apparatus as claimed in claim 2, wherein the groups of outlet openings are equally spaced along the length of the tube extending away from the main nozzle exit passage.

6. An apparatus as claimed in claim 2 wherein the groups of openings are spaced apart at progressively decreasing intervals along the length of the tube extending away from the main nozzle exit passage.

7. An apparatus as claimed in claim 2, wherein the groups of openings are spaced apart at progressively increasing intervals along the tube length extending away from the main nozzle exit passage.

8. An apparatus as claimed in claim 2, wherein each group of outlet openings includes sub-groups of openings also positioned so that the openings of each sub-group intersect a single plane extending transversely perpendicular to the axis of the tube.

9. An apparatus as claimed in any one of claims 1–7, wherein the openings are circular in shape.

10. An apparatus as claimed in claim 2, wherein the openings of each group are circular and wherein the diameter of the openings of each group increase progressively along the tube length extending away from the main nozzle exit passage.

11. An apparatus as claimed in claim 2, wherein the openings of each group are circular and the diameter of the openings of each group decrease progressively along the length of the tube extending away from the main nozzle exit passage.

12. An apparatus as claimed in any one of claims 1–7 wherein the shape of each outlet opening is oblong.

13. An apparatus as claimed in claim 12, wherein the greater length of the outlet openings extends parallel to the axis of the tube.

14. An apparatus as claimed in claim 12, wherein the greater length of the outlet openings extends perpendicular to the axis of the tube.

15. An apparatus as claimed in claim 1, wherein the outlet openings are oblong in shape and wherein the length of the openings of each group progressively decreases along the length of the tube extending away from the main nozzle exit passage.

16. An apparatus as claimed in claim 1, wherein the outlet openings of each group are oblong in shape, and wherein the length of the openings of each group are progressively shorter in length along the tube length extending away from the main nozzle exit passage.

17. An apparatus as claimed in claim 1, wherein the outlet openings of each group are oblong in shape and wherein the width of the openings of each group progressively decrease along the tube length extending away from the main nozzle exit passage.

18. An apparatus as claimed in claim 1, wherein the openings are oblong in shape, and wherein the width of the outlet openings of each group progressively decrease along the length of the tube extending away from the main nozzle exit passage.

* * * * *